US011183356B2

(12) United States Patent
Besen et al.

(10) Patent No.: US 11,183,356 B2
(45) Date of Patent: Nov. 23, 2021

(54) ROTARY ANODE UNIT AND X-RAY GENERATION APPARATUS

(71) Applicants: ENERGETIQ TECHNOLOGY, INC., Wilmington, MA (US); HAMAMATSU PHOTONICS K.K., Hamamatsu (JP)

(72) Inventors: Matthew M. Besen, Andover, MA (US); Ryosuke Yabushita, Hamamatsu (JP)

(73) Assignees: ENERGETIQ TECHNOLOGY, INC., Wilmington, MA (US); HAMAMATSU PHOTONICS K.K., Hamamatsu (JP)

( * ) Notice: Subject to any disclaimer, the term of this patent is extended or adjusted under 35 U.S.C. 154(b) by 57 days.

(21) Appl. No.: 16/836,137

(22) Filed: Mar. 31, 2020

(65) Prior Publication Data

US 2021/0305004 A1 Sep. 30, 2021

(51) Int. Cl.
*H01J 35/10* (2006.01)

(52) U.S. Cl.
CPC ..... *H01J 35/108* (2013.01)

(58) Field of Classification Search
CPC ..... H01J 35/108; H01J 35/08; H01J 35/10; H01J 35/101; H01J 35/105; H01J 35/106; H01J 2235/08; H01J 2235/081; H01J 2235/083; H01J 2235/082; H01J 2235/084; H01J 2235/1204
See application file for complete search history.

(56) References Cited

U.S. PATENT DOCUMENTS

| | | | | |
|---|---|---|---|---|
| 5,737,387 | A * | 4/1998 | Smither | H01J 35/106 378/130 |
| 7,079,625 | B2 | 7/2006 | Lenz | |
| 7,697,665 | B2 * | 4/2010 | Yonezawa | H01J 35/106 378/130 |
| 8,121,258 | B2 * | 2/2012 | Hoghoj | H01J 35/20 378/125 |
| 2017/0372865 | A1 * | 12/2017 | Ishihara | H01J 35/06 |

FOREIGN PATENT DOCUMENTS

| | | |
|---|---|---|
| CN | 109192643 A | 1/2019 |
| JP | 2006-073254 A | 3/2006 |
| JP | 2009-193789 A | 8/2009 |

(Continued)

*Primary Examiner* — Jurie Yun
(74) *Attorney, Agent, or Firm* — Faegre Drinker Biddle & Reath LLP

(57) ABSTRACT

A rotary anode unit includes a target formed of a first metal material and a target support body formed of a second metal material, formed in a flat plate shape, and having first and second surfaces. A thermal conductivity of the second metal material is higher than a thermal conductivity of the first metal material. A first recessed portion is formed in the first surface at the outer part of the target support body. The target is disposed in the first recessed portion. A second recessed portion configured to define a flow path for allowing a coolant to flow is formed in the second surface at the inner part of the target support body. A thickness of a first region where the first recessed portion is formed is larger than a thickness of a second region where the second recessed portion is formed.

9 Claims, 8 Drawing Sheets

(56) References Cited

FOREIGN PATENT DOCUMENTS

| | | | |
|---|---|---|---|
| JP | 4320415 | B2 | 8/2009 |
| JP | 2009-272057 | A | 11/2009 |
| JP | 2012-238506 | A | 12/2012 |
| JP | 5265906 | B2 | 8/2013 |
| JP | 2015-506557 | A | 3/2015 |
| JP | 6174043 | B2 | 8/2017 |
| WO | WO 2013/104008 | A1 | 7/2013 |

* cited by examiner

ROTARY ANODE UNIT AND X-RAY GENERATION APPARATUS

TECHNICAL FIELD

An aspect of the present disclosure relates to a rotary anode unit and an X-ray generation apparatus provided with a rotary anode unit.

BACKGROUND

In a known X-ray generation apparatus, an X-ray is generated by an electron beam emitted from a cathode being incident on a rotating target. In such an X-ray generation apparatus, the target is heated by electron absorption. As a target cooling-related technique, Japanese Patent No. 5265906 discloses water-cooling a disk-shaped target from a back side to which a shaft is connected.

SUMMARY

It may not be possible to sufficiently cool the target in a case where the thermal conductivity of the target or the heat transfer rate between the target and the shaft is low in the technique as described above. It is conceivable to improve the cooling performance by forming the part of the target other than an electron incident part with a material higher in thermal conductivity than the material of the electron incident part. However, merely using the high-thermal conductivity material does not bring a sufficient cooling performance.

An object of an aspect of the present disclosure is to provide a rotary anode unit and an X-ray generation apparatus enhanced in terms of cooling performance.

A rotary anode unit according to an aspect of the present disclosure includes a target formed of a first metal material, formed in an annular shape, and constituting an annular electron incident surface and a target support body formed of a second metal material, formed in a flat plate shape, and having a first surface extending substantially perpendicularly to a rotation axis and a second surface on a side opposite to the first surface. A thermal conductivity of the second metal material is higher than a thermal conductivity of the first metal material. The target support body has an inner part including the rotation axis and an outer part to which the target is fixed. A first recessed portion is formed in the first surface at the outer part. The target is disposed in the first recessed portion and the electron incident surface of the target is positioned on the same plane as the first surface. A second recessed portion configured to define a flow path for allowing a coolant to flow is formed in the second surface at the inner part. A thickness of a first region where the first recessed portion is formed at the outer part is larger than a thickness of a second region where the second recessed portion is formed at the inner part.

In this rotary anode unit, the target support body is formed of the second metal material higher in thermal conductivity than the first metal material constituting the target. Thus, the cooling performance can be improved. In addition, the first recessed portion where the target is disposed is formed in the first surface at the outer part of the target support body and the second recessed portion configured to define the flow path for allowing the coolant to flow is formed in the second surface at the inner part of the target support body. The thickness of the first region where the first recessed portion is formed at the outer part is larger than the thickness of the second region where the second recessed portion is formed at the inner part. Thus, it is possible to increase the heat capacity of the first region and enhance the cooling efficiency in the second region. As a result, the heat generated in the target can be stored in the first region and the heat stored in the first region can be efficiently cooled in the second region. Accordingly, the cooling performance is enhanced in the rotary anode unit. Further, the electron incident surface of the target is positioned on the same plane as the first surface of the target support body extending substantially perpendicularly to the rotation axis. As a result, the workability of polishing work on the electron incident surface and the first surface is enhanced.

A difference between the thickness of the second region and a thickness of the target may be smaller than a difference between the thickness of the first region and the thickness of the second region. In this case, it is possible to easily transmit the heat generated in the target to the first region having a large-heat capacity while further enhancing the cooling efficiency in the second region.

A surface roughness Ra of at least one of a bottom surface of the first recessed portion and a surface of the target being in contact with the bottom surface may be 1.6 μm or less. In this case, the target and the target support body can be suitably brought into surface contact with each other and the cooling efficiency can be further enhanced.

A surface roughness Ra of the electron incident surface of the target may be 0.5 μm or less. In this case, it is possible to emit a large amount of X-rays from the target when an electron beam is incident.

A contact width between the target and a bottom surface of the first recessed portion may be 2 t or more and 8 t or less when a thickness of the target is t. In this case, since the contact width is 2 t or more, it is possible to increase the contact area between the target and the target support body and it is possible to further enhance the cooling efficiency. In addition, since the contact width is 8 t or less, it is possible to ensure the area of the second region and it is possible to further enhance the cooling efficiency in the second region.

An insertion hole penetrating through a bottom surface of the first recessed portion and the second surface may be formed at the outer part and the target may be fixed to the target support body by a fastening member inserted through the insertion hole. In this case, the target and the target support body can be more closely fixed.

The rotary anode unit according to an aspect of the present disclosure may further include a shaft fixed to the target support body from the second surface side and defining the flow path together with the second recessed portion. In this case, the target support body can be rotated via the shaft and the flow path can be defined by the second recessed portion and the shaft.

The rotary anode unit according to an aspect of the present disclosure may further include a flow path forming member having a tubular portion disposed in the shaft and a flange portion protruding outward from the tubular portion, the flow path forming member being defining the flow path together with the second recessed portion and the shaft. In this case, the flow path can be defined by the second recessed portion, the shaft, and the flow path forming member.

An X-ray generation apparatus according to an aspect of the present disclosure includes the rotary anode unit. With the X-ray generation apparatus, the cooling performance is enhanced for the reasons described above.

According to an aspect of the present disclosure, it is possible to provide a rotary anode unit and an X-ray generation apparatus enhanced in terms of cooling performance.

DETAILED DESCRIPTION

Hereinafter, an embodiment of the present disclosure will be described in detail with reference to the drawings. In the following description, the same or corresponding elements will be denoted by the same reference signs without redundant description.

[X-Ray Generation Apparatus]

Figure 1:
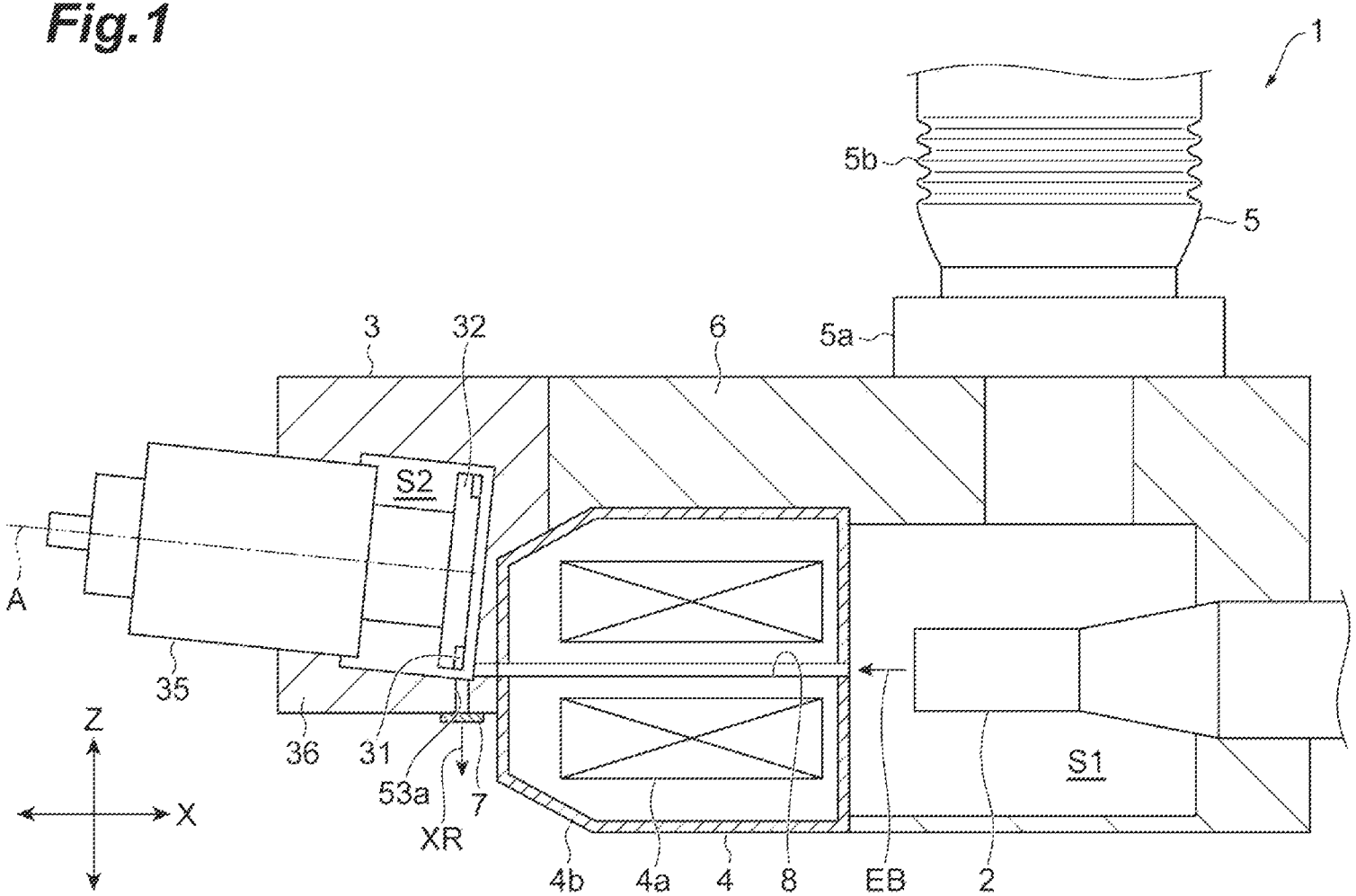
FIG. 1 is a configuration diagram of an X-ray generation apparatus according to an embodiment.

As illustrated in FIG. 1, an X-ray generation apparatus 1 includes an electron gun 2, a rotary anode unit 3, a magnetic lens 4, an exhaust unit 5, and a housing 6. The electron gun 2 is disposed in the housing 6 and emits an electron beam EB. The rotary anode unit 3 has an annular plate-shaped target 31. The target 31 is supported so as to be rotatable around a rotation axis A, receives the electron beam EB while rotating, and generates an X-ray XR. The X-ray XR is emitted to the outside from an X-ray passage hole 53*a* formed in a housing 36 of the rotary anode unit 3. The X-ray passage hole 53*a* is airtightly blocked by a window member 7. The rotation axis A is inclined with respect to the direction axis (the emission axis of the electron beam EB) in which the electron beam EB is incident on the target 31. Details of the rotary anode unit 3 will be described later.

The magnetic lens 4 controls the electron beam EB. The magnetic lens 4 has one or a plurality of coils 4*a* and a housing 4*b* accommodating the coils 4*a*. Each coil 4*a* is disposed so as to surround a passage 8 through which the electron beam EB passes. Each coil 4*a* is an electromagnetic coil that generates a magnetic force acting on the electron beam EB between the electron gun 2 and the target 31 by energization. The one or plurality of coils 4*a* include, for example, a focusing coil that focuses the electron beam EB on the target 31. The one or plurality of coils 4*a* may include a deflection coil that deflects the electron beam EB. The focusing coil and the deflection coil may be arranged along the passage 8.

The exhaust unit 5 has an exhaust pipe 5*a* and a vacuum pump 5*b*. The exhaust pipe 5*a* is provided in the housing 6 and connected to the vacuum pump 5*b*. The vacuum pump 5*b* vacuumizes an internal space S1 defined by the housing 6 via the exhaust pipe 5*a*. The housing 6 defines the internal space S1 together with the housing 4*b* of the magnetic lens 4 and maintains the internal space S1 in a vacuumized state. An internal space S2 defined by the housing 36 of the rotary anode unit 3 as well as the passage 8 is vacuumized as a result of the vacuumization by the vacuum pump 5*b*. The vacuum pump 5*b* may not be provided in a case where the housing 6 is airtightly sealed in a state where the internal spaces S1 and S2 and the passage 8 are vacuumized.

In the X-ray generation apparatus 1, a voltage is applied to the electron gun 2 in a state where the internal spaces S1 and S2 and the passage 8 are vacuumized and the electron beam EB is emitted from the electron gun 2. The electron beam EB is focused so as to have a desired focus on the target 31 by the magnetic lens 4 and is incident on the target 31 that is rotating. When the electron beam EB is incident on the target 31, the X-ray XR is generated at the target 31 and the X-ray XR is emitted to the outside from the X-ray passage hole 53*a*.

[Rotary Anode Unit]

As illustrated in FIGS. 2 to 5, the rotary anode unit 3 includes the target 31, a target support body (rotary support body) 32, a shaft 33, and a flow path forming member 34.

The target 31 is formed in an annular plate shape and constitutes an annular electron incident surface 31*a*. The target support body 32 is formed in a circular flat plate shape. The target 31 has the electron incident surface 31*a* on which the electron beam EB is incident, a back surface 31*b* on a side opposite to the electron incident surface 31*a*, and an inside surface 31*c* and an outside surface 31*d* connected to the electron incident surface 31*a* and the back surface 31*b*. The electron incident surface 31*a* and the back surface 31*b* face each other so as to be parallel to each other. The target support body 32 has a surface (first surface) 32*a* extending substantially perpendicularly to the rotation axis A, a back surface (second surface) 32*b* on a side opposite to the surface 32*a*, and a side surface 32*c* connected to the surface 32*a* and the back surface 32*b*. The surface 32*a* and the back surface 32*b* face each other so as to be parallel to each other. A plurality of members may constitute the target 31 although a single member constitutes the target 31 in this example.

A first metal material constituting the target 31 is, for example, a heavy metal such as tungsten, silver, rhodium, molybdenum, or an alloy thereof. A second metal material constituting the target support body 32 is, for example, copper, a copper alloy, or the like. The first metal material and the second metal material are selected such that the thermal conductivity of the second metal material is higher than the thermal conductivity of the first metal material.

The target support body 32 has an outer part 41 to which the target 31 is fixed and an inner part 42 including the rotation axis A (the rotation axis A passes through the inner part 42). The inner part 42 is formed in a circular shape. The outer part 41 is formed in an annular shape and surrounds the inner part 42. A first recessed portion 43 is formed in the surface 32*a* at the outer part 41. The first recessed portion 43 has an annular recess structure corresponding to the target 31. The first recessed portion 43 extends such that the outside of the first recessed portion 43 is opened along the outer edge of the target support body 32 and is exposed on the side surface 32*c*.

The surface 32*a* at the inner part 42 is a continuous flat surface having a circular shape and extending substantially perpendicularly to the rotation axis A. For example, the surface 32*a* extends perpendicularly to the rotation axis A. "Continuous flat surface" means that, for example, the entire surface is positioned on one plane without a hole, a recessed portion, a projection, or the like being formed. As will be described later, the electron incident surface 31*a* and the surface 32*a* are simultaneously polished in the process of manufacturing the rotary anode unit 3, and thus the surface 32*a* may be a continuous flat surface particularly in a second region R2 (described later) where a second recessed portion 44 serving as the main portion of the surface 32*a* is formed. The outer edge part outside the second region R2 may be provided with, for example, a balance adjustment hole 42*b* (described later).

The target 31 is disposed so as to fit in the first recessed portion 43. The entire electron incident surface 31*a* of the target 31 is positioned on the same plane as the surface 32*a* of the target support body 32. In this example, the electron incident surface 31*a* is gaplessly continuous with the surface 32*a*. In the process of manufacturing the rotary anode unit 3, the electron incident surface 31*a* and the surface 32*a* are simultaneously polished after the target 31 is disposed in the first recessed portion 43. As a result, the electron incident surface 31*a* and the surface 32*a* are positioned on the same plane. However, there may be a slight height difference between the electron incident surface 31*a* and the surface 32*a* due to, for example, the hardness difference between the first metal material constituting the target 31 and the second metal material constituting the target support body 32. For example, in a case where the thickness of the target 31 is approximately several millimeters and the hardness of the first metal material is higher than the hardness of the second metal material, the electron incident surface 31*a* may protrude by, for example, approximately tens of micrometers with respect to the surface 32*a*. The meaning of "the electron incident surface 31*a* and the surface 32*a* are positioned on the same plane" includes a case where the electron incident surface 31*a* can be regarded as being positioned substantially on the same plane as the surface 32*a* although there is such a slight height difference.

The entire back surface 31*b* of the target 31 is in contact with a bottom surface 43*a* of the first recessed portion 43. The entire inside surface 31*c* of the target 31 is in contact with a side surface 43*b* of the first recessed portion 43. Although the entire back surface 31*b* of the target 31 and the entire inside surface 31*c* of the target 31 may be in surface contact with the first recessed portion 43 from the viewpoint of the heat dissipation of the target 31, the back surface 31*b* and the inside surface 31*c* may be in contact with the first recessed portion 43 at least in part. The outside surface 31*d* of the target 31 is positioned on the same plane as the side surface 32*c* of the target support body 32. The outside surface 31*d* of the target 31 may protrude from the side surface 32*c* or be recessed without being positioned on the same plane as the side surface 32*c* of the target support body 32. Assuming that the thickness (maximum thickness) of the target 31 is t, a contact width W between the bottom surface 43*a* of the first recessed portion 43 and the target 31 is 2 t or more and 8 t or less. The flatness and parallelism of the electron incident surface 31*a* are 15 μm or less.

A surface roughness Ra of the entire electron incident surface 31*a* of the target 31 is 0.5 μm or less. In other words, the electron incident surface 31*a* is polished such that the surface roughness Ra is 0.5 μm or less. Accordingly, the surface roughness Ra of the surface 32*a* is also 0.5 μm or less. The surface roughnesses Ra of both the back surface 31*b* of the target 31 (surface coming into contact with the bottom surface 43*a* of the first recessed portion 43) and the bottom surface 43*a* of the first recessed portion 43 are 0.8 μm or less. The sum of the surface roughness Ra of the back surface 31*b* and the surface roughness Ra of the bottom surface 43*a* is 1.6 μm or less. In other words, the back surface 31*b* and the bottom surface 43*a* are polished such that the surface roughness Ra is 0.8 μm or less. The surface roughness Ra is an arithmetic average roughness specified by the Japanese Industrial Standards (JIS B 0601).

Figure 2:
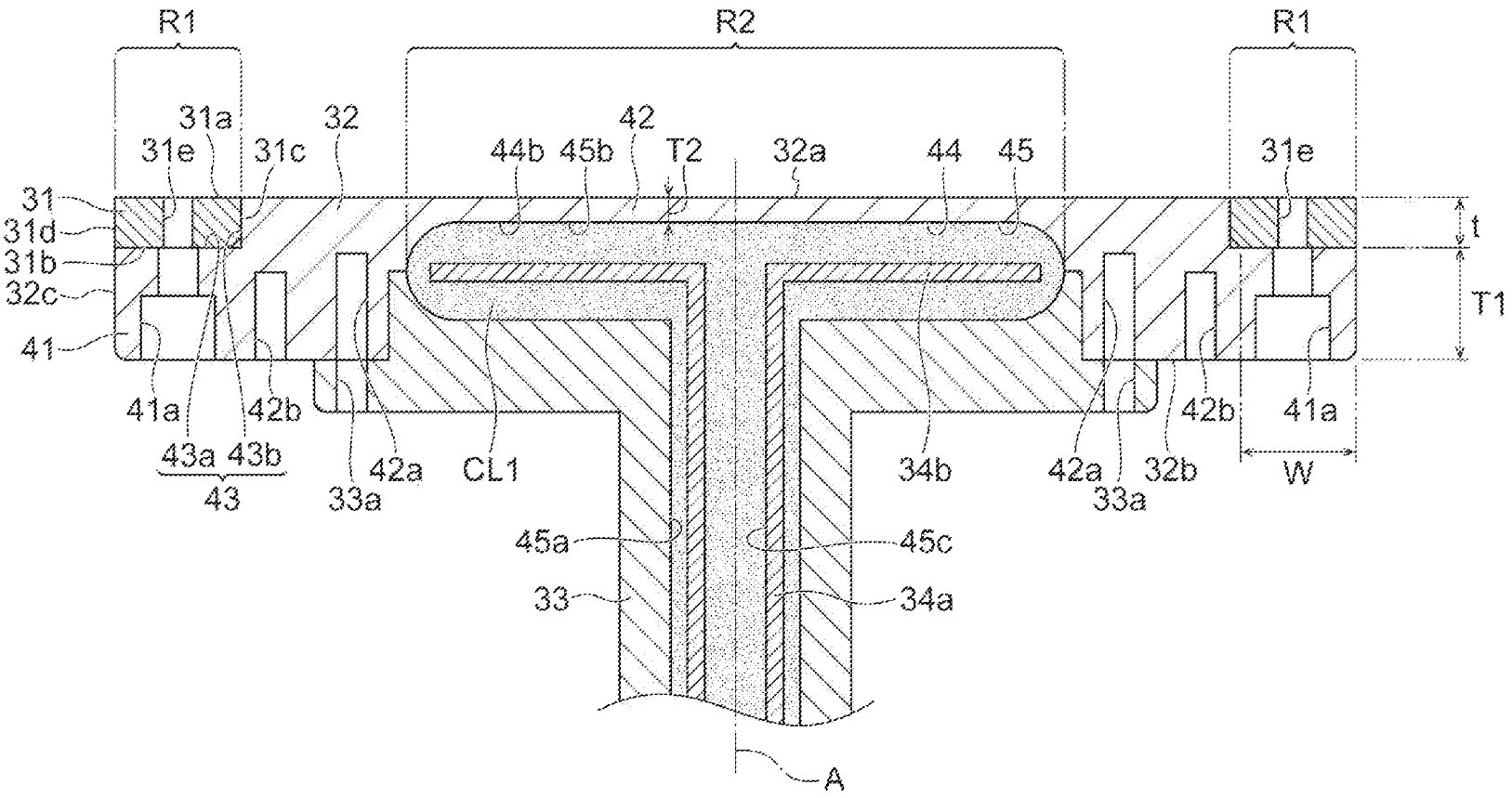
FIG. 2 is a cross-sectional view of a part of a rotary anode unit.
Figure 3:
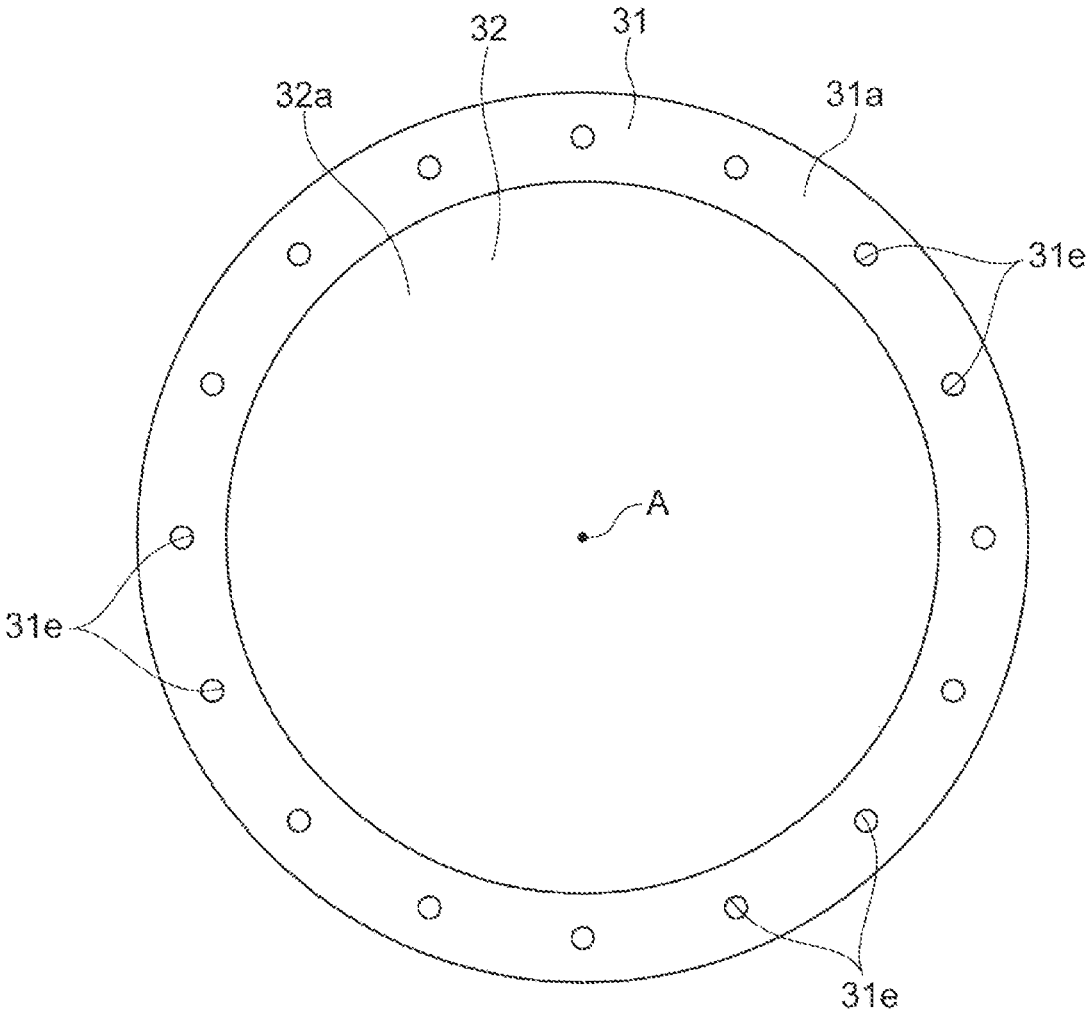
FIG. 3 is a front view of a target and a target support body.
Figure 4:
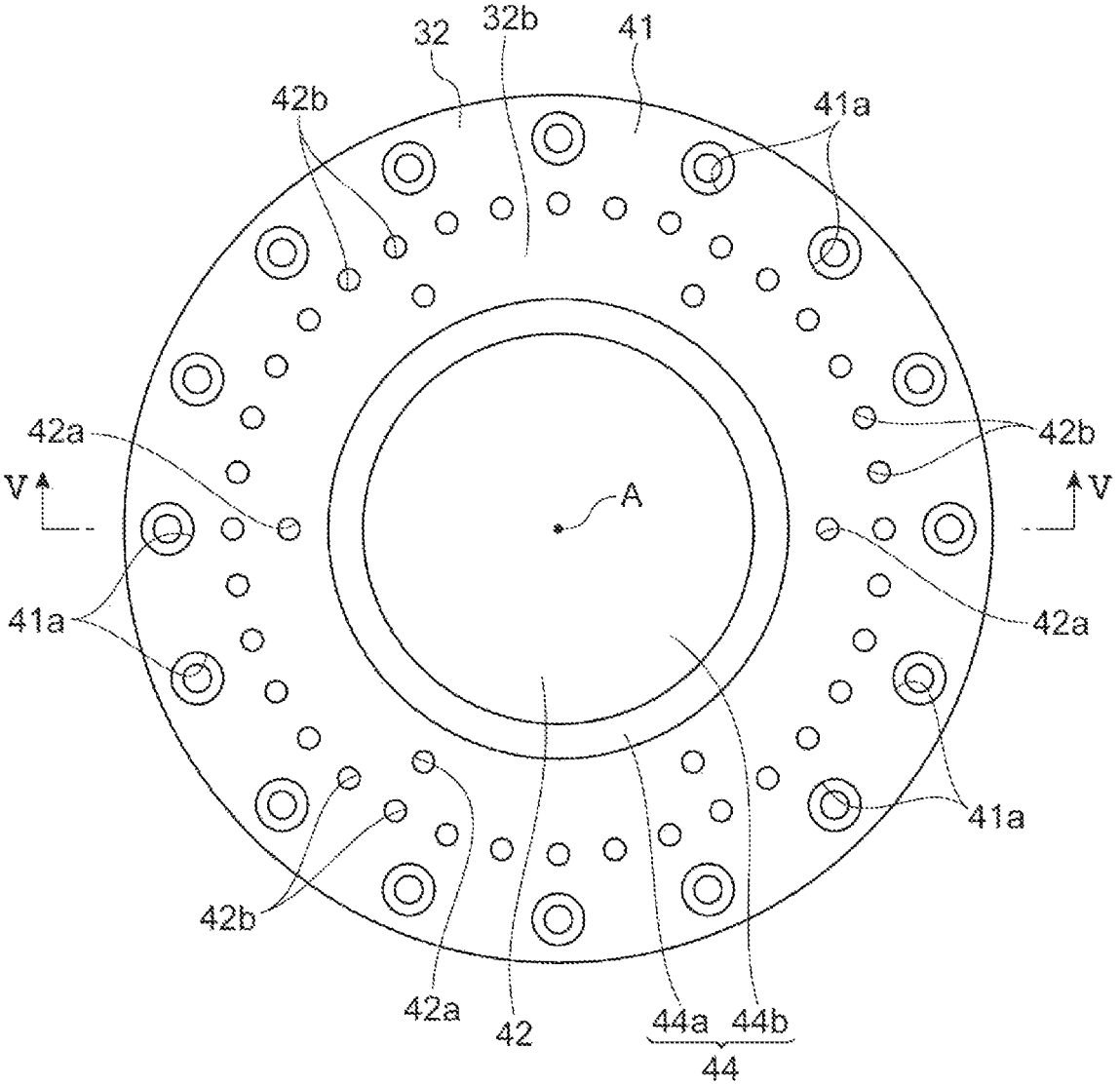
FIG. 4 is a bottom view of the target support body.
Figure 5:
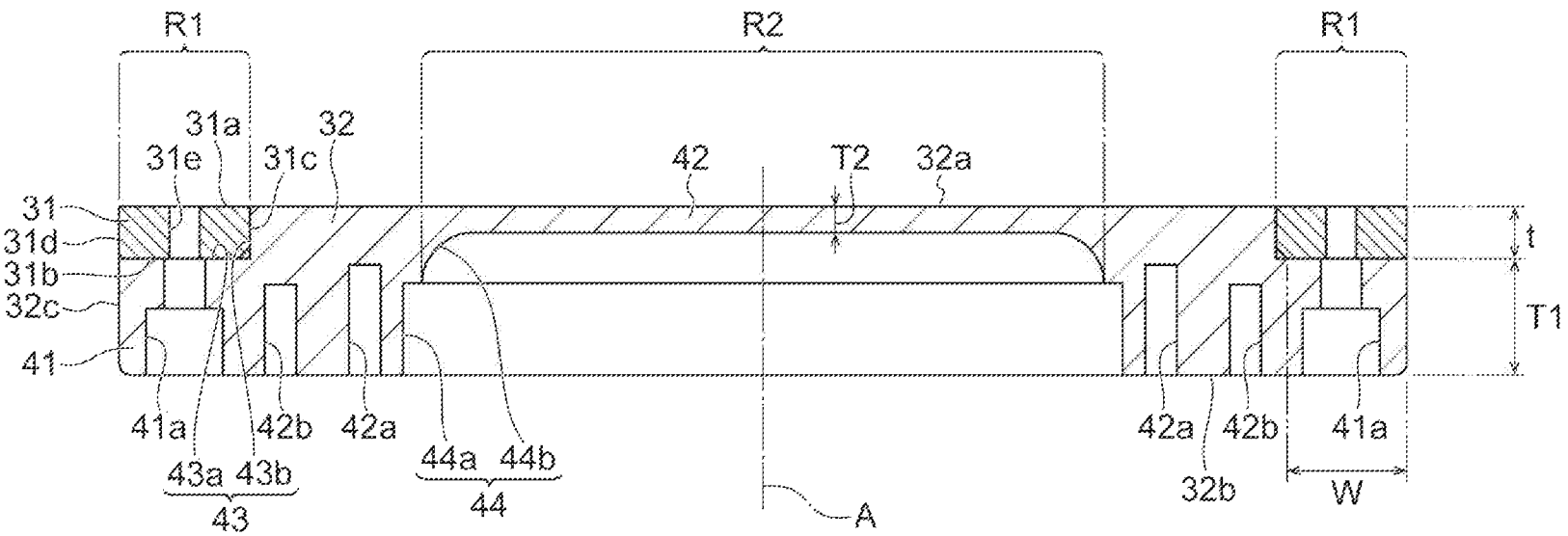
FIG. 5 is a cross-sectional view taken along line V-V in FIG. 4.

The second recessed portion 44 is formed in the back surface 32*b* at the inner part 42. The second recessed portion 44 defines, together with the shaft 33 and the flow path forming member 34, a flow path 45 for allowing a coolant CL1 to flow. As illustrated in FIGS. 2 and 5, the second recessed portion 44 has a first part 44*a* where the shaft 33 and the flow path forming member 34 are disposed and a second part 44*b* connected to the first part 44*a* and constituting the flow path 45. The first part 44*a* is formed in a columnar shape and the second part 44*b* is formed in a bottomed recessed portion shape. The peripheral surface of the second part 44*b* is a curved surface that curves so as to approach the rotation axis A as it goes away from the shaft 33. The second recessed portion 44 is separated from (does not overlap with) the first recessed portion 43 (target 31) when viewed from a direction parallel to the rotation axis A.

A thickness T1 of a first region R1 where the first recessed portion 43 is formed at the outer part 41 is larger than a thickness T2 of the second region R2 where the second recessed portion 44 is formed at the inner part 42. The thickness T1 is the maximum thickness in the first region R1. The thickness T2 is the minimum thickness in the second region R2. The difference between the thickness T2 of the second region R2 and the thickness t of the target 31 (depth of the first recessed portion 43) is smaller than the difference between the thickness T1 of the first region R1 and the thickness T2 of the second region R2. In this example, the thickness T2 of the second region R2 is smaller than the thickness t of the target 31 (depth of the first recessed portion 43).

Formed at the outer part 41 are a plurality of (16 in this example) insertion holes 41*a* penetrating through the bottom surface 43*a* of the first recessed portion 43 and the back surface 32*b* of the target support body 32. The plurality of insertion holes 41*a* are arranged at equal intervals along the circumferential direction of a circle about the rotation axis A. Formed at the target 31 are a plurality of (16 in this example) fastening holes 31*e* penetrating through the electron incident surface 31*a* and the back surface 31*b*. The target 31 is detachably fixed to the target support body 32 by a fastening member (not illustrated) inserted through the insertion hole 41*a* being fastened to the fastening hole 31*e*. The fastening member may be, for example, a bolt. Brazing, diffusion bonding, or the like as well as the fastening structure may be used for the fixing between the target 31 and the target support body 32.

Formed in the back surface 32*b* at the inner part 42 are a plurality of (six in this example) fastening holes 42*a* for fixing the shaft 33. The plurality of fastening holes 42*a* are arranged at equal intervals along the edge of the second recessed portion 44 and along the circumferential direction of a circle about the rotation axis A. The shaft 33 is detachably fixed to the target support body 32 by a fastening member (not illustrated) inserted through an insertion hole 33*a* of the shaft 33 being fastened to the fastening hole 42*a*. The fastening member may be, for example, a bolt.

Formed in the back surface 32*b* at the inner part 42 are a plurality of (36 in this example) the balance adjustment holes 42*b* for adjusting the weight balance of the rotary anode unit 3. The plurality of balance adjustment holes 42*b* are arranged at equal intervals along the circumferential direction of a circle about the rotation axis A. It is possible to adjust the weight balance of the rotary anode unit 3 by, for example, fixing a weight (not illustrated) to one or a plurality of holes selected from the plurality of balance adjustment holes 42*b*. The weight may be fixed to the target support body 32 by, for example, a fastening member such as a bolt being fastened to the balance adjustment hole 42*b*. The weight balance of the rotary anode unit 3 may be adjusted by the balance adjustment hole 42*b* being enlarged by shaving or the like. The balance adjustment hole 42*b* may be provided at the outer edge part of the surface 32*a* that is outside the second region R2 as described above. The weight balance of the rotary anode unit 3 may be adjusted by weight addition or partial removal with respect to the location in the target support body 32 other than the balance adjustment hole 42*b*. A configuration for adjusting the weight balance of the rotary anode unit 3 may be provided in this manner in the region that is an outer edge with respect to the rotation axis A, particularly in the region that is outside the region where the flow path 45 is formed.

The shaft 33 and the flow path forming member 34 are fixed to the target support body 32 from the back surface 32*b* side. A part of the shaft 33 is disposed at the first part 44*a* of the second recessed portion 44. The shaft 33 is fixed to the target support body 32 by the fastening member fastened to the fastening hole 42*a* as described above. The flow path forming member 34 has a tubular portion 34*a* and a flange portion 34*b* protruding outward from an end portion of the tubular portion 34*a*. The tubular portion 34*a* is formed in a cylindrical shape and disposed in the shaft 33. The flange portion 34*b* is formed in a disk shape and faces each of the surface of the second recessed portion 44 and the shaft 33 at an interval. The flow path forming member 34 is fixed to the non-rotating portion (not illustrated) of the rotary anode unit 3 so as not to rotate together with the target support body 32 and the shaft 33.

The second recessed portion 44, the shaft 33, and the flow path forming member 34 define the flow path 45 for allowing the coolant CL1 to flow. The coolant CL1 is a liquid coolant such as water and antifreeze. The flow path 45 has a first part 45*a* formed between the shaft 33 and the tubular portion 34*a* and the flange portion 34*b* of the flow path forming member 34, a second part 45*b* formed between the target support body 32 and the flange portion 34*b* of the flow path forming member 34, and a third part 45*c* formed in the tubular portion 34*a* of the flow path forming member 34. The coolant CL1 is supplied to the first part 45*a* from, for example, a coolant supply device (not illustrated). The coolant supply device may be a chiller capable of supplying the coolant CL1 adjusted to a predetermined temperature. The coolant CL1 supplied to the first part 45*a* flows through the second part 45*b* and is discharged at the third part 45*c*.

The rotary anode unit 3 further includes a drive unit 35 rotationally driving the target 31, the target support body 32, and the shaft 33 and the housing 36 accommodating the target 31, the target support body 32, the shaft 33, and the flow path forming member 34 (FIG. 1). The drive unit 35 may have a motor as a drive source. The target 31, the target support body 32, and the shaft 33 integrally rotate around the rotation axis A by the shaft 33 being rotated by the drive unit 35.

As described above, in the rotary anode unit 3, the target support body 32 is formed of the second metal material higher in thermal conductivity than the first metal material constituting the target 31. Thus, the cooling performance can be improved. In addition, the first recessed portion 43 where the target 31 is disposed is formed in the surface 32*a* at the outer part 41 of the target support body 32 and the second recessed portion 44 defining the flow path 45 for allowing the coolant CL1 to flow is formed in the back surface 32*b* at the inner part 42 of the target support body 32. The thickness T1 of the first region R1 where the first recessed portion 43 is formed at the outer part 41 is larger than the thickness T2 of the second region R2 where the second recessed portion 44 is formed at the inner part 42. Thus, it is possible to increase the heat capacity of the first region R1 and enhance the cooling efficiency in the second region R2. As a result, the heat generated in the target 31 can be stored in the first region R1 and the heat stored in the first region R1 can be efficiently cooled in the second region R2. Accordingly, the cooling performance is enhanced in the rotary anode unit 3. Further, the electron incident surface 31*a* of the target 31 is positioned on the same plane as the surface 32*a* of the target support body 32 extending substantially perpendicularly to the rotation axis A. As a result, the workability of polishing work on the electron incident surface 31*a* and the surface 32*a* is enhanced.

The X-ray generation apparatus 1 was prepared and evaluated as a confirmation experiment. In a case where the cooling performance is not sufficient, the temperature of the target support body 32 may become as high as 100° C. or more and the coolant CL1 may be boiled. However, the coolant CL1 was not heated to the point of boiling during a 1,000-hour operation. No deformation or damage occurred in the target 31. A change of 3% or more did not occur in the dose of the X-ray XR.

The difference between the thickness T2 of the second region R2 and the thickness t of the target 31 is smaller than the difference between the thickness T1 of the first region R1 and the thickness T2 of the second region R2. As a result, it is possible to easily transmit the heat generated in the target 31 to the first region R1 having a large-heat capacity while further enhancing the cooling efficiency in the second region R2.

The surface roughnesses Ra of both the bottom surface 43*a* of the first recessed portion 43 and the back surface 31*b* of the target 31 coming into contact with the bottom surface 43*a* are 1.6 μm or less. As a result, the target 31 and the target support body 32 can be suitably brought into surface contact with each other and the cooling efficiency can be further enhanced. In other words, the surface area of the contact surface between the target 31 and the target support body 32 can be increased.

The surface roughness Ra of the electron incident surface 31*a* of the target 31 is 0.5 μm or less. As a result, it is possible to emit a large amount of X-rays from the target 31 when an electron beam is incident. In other words, it is possible to suppress self-absorption in which the X-rays emitted from the target 31 are blocked by the unevenness of the surface of the electron incident surface 31*a*. When the surface of the electron incident surface 31*a* is uneven, stress concentration occurs at the uneven part. However, it is possible to mitigate such stress concentration by reducing the surface roughness of the electron incident surface 31*a*.

The contact width W between the target 31 and the bottom surface 43*a* of the first recessed portion 43 is 2 t or more and 8 t or less. Since the contact width W is 2 t or more, it is possible to increase the contact area between the target 31 and the target support body 32 and it is possible to further enhance the cooling efficiency. In addition, since the contact width W is 8 t or less, it is possible to ensure the area of the second region R2 and it is possible to further enhance the cooling efficiency in the second region R2.

The insertion hole 41*a* penetrating through the bottom surface 43*a* of the first recessed portion 43 and the back surface 32*b* of the target support body 32 is formed at the outer part 41. The target 31 is fixed to the target support body 32 by the fastening member inserted through the insertion hole 41*a*. As a result, the target 31 and the target support body 32 can be more closely fixed.

The rotary anode unit 3 is provided with the shaft 33 fixed to the target support body 32 from the back surface 32*b* side and defining the flow path 45 together with the second recessed portion 44. As a result, the target support body 32 can be rotated via the shaft 33 and the flow path 45 can be defined by the second recessed portion 44 and the shaft 33.

The rotary anode unit 3 is provided with the flow path forming member 34. The flow path forming member 34 has the tubular portion 34*a* disposed in the shaft 33 and the flange portion 34*b* protruding outward from the tubular portion 34*a*. The flow path forming member 34 defines the flow path 45 together with the second recessed portion 44 and the shaft 33. As a result, the flow path 45 can be defined by the second recessed portion 44, the shaft 33, and the flow path forming member 34.

[Cooling Mechanism for Magnetic Lens]

Figure 6:
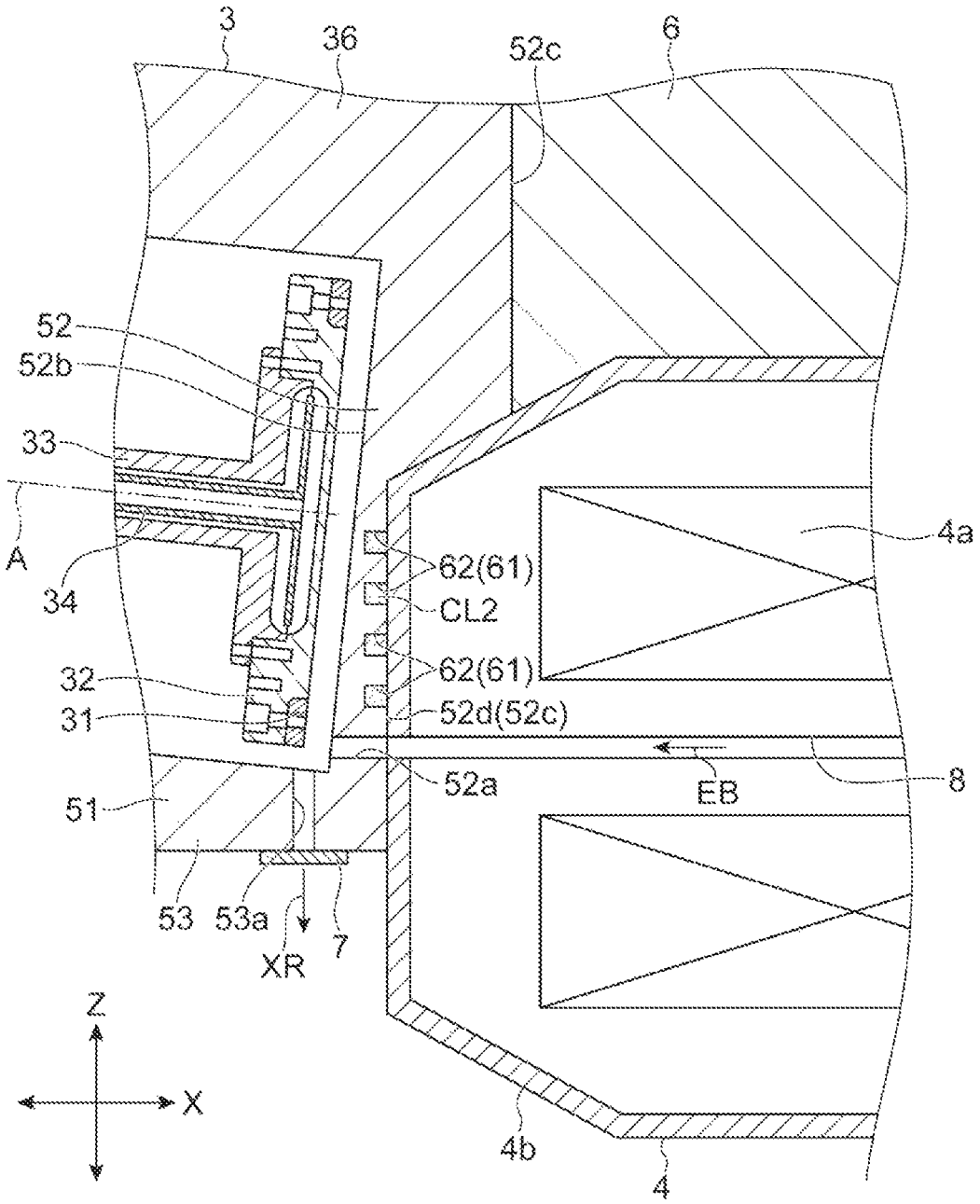
FIG. 6 is a partial enlarged view of FIG. 1.

As illustrated in FIG. 6, the housing 36 of the rotary anode unit 3 has a wall portion 51. The wall portion 51 includes a first wall 52 and a second wall 53. The first wall 52 is disposed between the target 31 and the coil 4*a* of the magnetic lens 4 so as to face the target 31. The first wall 52 is formed in a plate shape and extends so as to intersect with the rotation axis A and the X direction (first direction in which the electron beam EB passes through an electron passage hole 52*a*). The electron passage hole 52*a* through which the electron beam EB passes is formed in the first wall 52. The electron passage hole 52*a* penetrates the first wall 52 along the X direction (direction along the tube axis of the X-ray generation apparatus 1 and the emission axis of the electron beam EB) and is connected to the passage 8 of the magnetic lens 4.

The second wall 53 is formed in a plate shape and extends from the first wall 52 along the X direction. The X-ray passage hole 53*a* through which the X-ray XR emitted from the target 31 passes is formed in the second wall 53. The X-ray passage hole 53*a* penetrates the second wall 53 along the Z direction (third direction) perpendicular to the X direction. The window member 7 is provided on the outer surface of the second wall 53 so as to airtightly block the X-ray passage hole 53*a*. The window member 7 is formed of a metal material or the like and in a flat plate shape and transmits the X-ray XR. Beryllium (Be) is an example of the metal material that constitutes the window member 7.

As illustrated in FIG. 6, the first wall 52 has a first surface 52*b* and a second surface 52*c* on a side opposite to the first surface 52*b*. The first surface 52*b* faces the electron incident surface 31*a* of the target 31 and the surface 32*a* of the target support body 32. The first surface 52*b* extends in parallel to the electron incident surface 31*a* and the surface 32*a* and is inclined with respect to the X direction and the Z direction.

The second surface 52*c* faces the housing 4*b* of the magnetic lens 4. In this example, the second surface 52*c* and the housing 4*b* are in contact with each other. The second surface 52*c* includes an abutting part 52*d*. The abutting part 52*d* is a flat surface and extends perpendicularly to the X direction. The outer surface of the housing 4*b* of the magnetic lens 4 abuts against the abutting part 52*d*. The outer surfaces of the housing 4*b* and the housing 6 and the second surface 52*c* (abutting part 52*d*) are joined by, for example, brazing or diffusion bonding. The housing 36 of the rotary anode unit 3 may be detachably attached to the housing 4*b* and the housing 6. In that case, an airtight sealing member such as an O-ring may be interposed between the second surface 52*c* (abutting part 52*d*) and the housings 4*b* and 6.

A flow path 61 for allowing a coolant CL2 to flow is formed in the first wall 52. A groove 62 is formed at the abutting part 52*d* of the second surface 52*c* of the first wall 52. The flow path 61 is defined by the groove 62 being blocked by the housing 4*b* of the magnetic lens 4. The coolant CL2 is supplied to the flow path 61 from, for example, a coolant supply device (not illustrated). The coolant supply device may be a chiller capable of supplying the coolant CL2 adjusted to a predetermined temperature. The coolant CL2 is a liquid coolant such as water and antifreeze.

Figure 7:
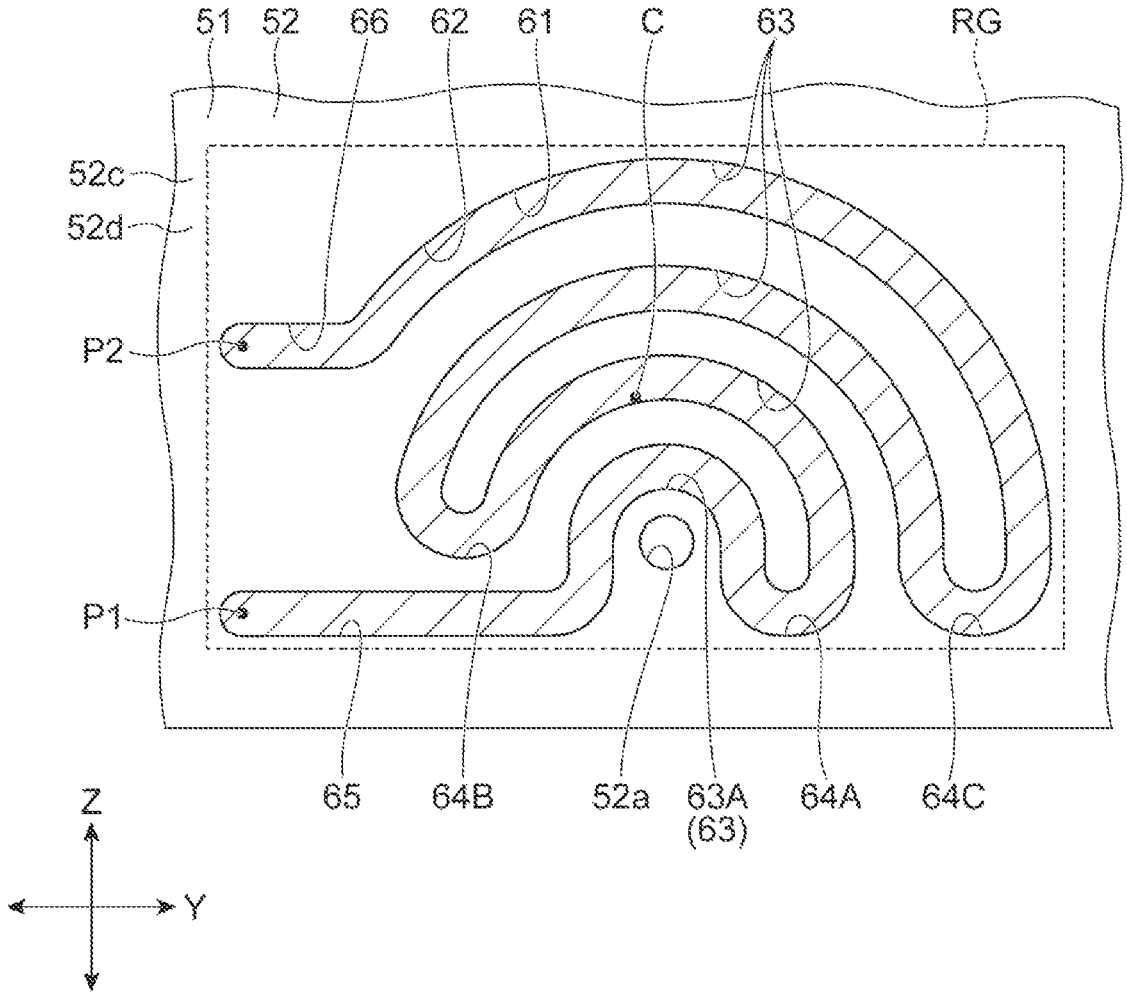
FIG. 7 is a front view of a housing of the rotary anode unit.

FIG. 7 is a diagram in which the second surface 52*c* of the first wall 52 is viewed from the X direction. Hereinafter, the shape of the flow path 61 as viewed from the X direction will be described with reference to FIG. 7. In FIG. 7, the flow path 61 is hatched for easy understanding. The flow path 61 meanderingly extends between a supply position P1 where the coolant CL2 is supplied and a discharge position P2 where the coolant CL2 is discharged. The flow path 61 includes a plurality of (four in this example) curved parts 63 extending along the circumferential direction of a circle about the electron passage hole 52*a*. The plurality of curved parts 63 are arranged at substantially equal intervals along the Z direction (third direction perpendicular to the first direction).

The flow path 61 includes a plurality of (three in this example) connection portions 64A to 64C alternately interconnecting the plurality of curved parts 63. The connection portions 64A to 64C extend in a curved manner. The flow path 61 further includes a linear part 65 interconnecting the supply position P1 and the curved part 63 and a linear part 66 interconnecting the curved part 63 and the discharge position P2.

A curved part 63A, which is closest to the electron passage hole 52*a* among the plurality of curved parts 63, is positioned on both sides of the electron passage hole 52*a* in the Y direction (second direction perpendicular to the first direction). In other words, the flow path 61 extends on both sides of the electron passage hole 52*a* in the Y direction so as to sandwich the electron passage hole 52*a* (to surround the electron passage hole 52*a* in a U shape).

In the flow path 61, the coolant CL2 flows from the supply position P1 to the discharge position P2. In the flow path 61, the part on the upstream side (side close to the supply position P1) is disposed closer to the electron passage hole 52*a* than the part on the downstream side (discharge position P2 side). For example, the curved part 63A is disposed closer to the electron passage hole 52*a* than the curved part 63 other than the curved part 63A. In other words, the flow path 61 includes a first part (the curved part 63A) and a second part (the curved part 63 other than the curved part 63A) connected to the first part and positioned on the side opposite to the electron passage hole 52*a* with respect to the first part and the X-ray generation apparatus 1 is configured such that the coolant CL2 flows from the first part to the second part. In this manner, a coolant is first introduced (a coolant that is lower in temperature is introduced) into the region that is close to the electron passage hole 52*a*, and thus the cooling efficiency of the structure near the electron passage hole 52*a* can be improved. In the vicinity of the electron passage hole 52*a*, the temperature is likely to increase due to the effect of the electron beam EB (reflected electrons from the target 31 in particular).

A center C of a region RG where the flow path 61 is formed in the first wall 52 is positioned on the side opposite to the X-ray passage hole 53*a* (upper side in FIG. 7) with respect to the electron passage hole 52*a*. In other words, the flow path 61 is formed close to the side opposite to the X-ray passage hole 53*a* with respect to the electron passage hole 52*a*.

As described above, in the X-ray generation apparatus 1, the rotary anode unit 3 is configured to rotate the target 31. Thus, the electron beam EB can be incident on the rotating target 31 and it is possible to avoid the electron beam EB being locally incident on the target 31. As a result, it is possible to increase the incident amount of the electron beam EB. In addition, the flow path 61 configured such that the coolant CL2 flows as well as the electron passage hole 52*a* through which the electron beam EB passes is formed in the first wall 52 (wall portion 51) disposed between the target 31 and the coil 4*a* and facing the target 31. As a result, the wall portion 51 and the magnetic lens 4 can be cooled by letting the coolant CL2 flow through the flow path 61. Accordingly, it is possible to suppress an increase in the temperature of the wall portion 51 and the magnetic lens 4 even in a case where the incident amount of the electron beam EB to the target 31 increases and the reflected electrons from the target 31 increase. As a result, with the X-ray generation apparatus 1, it is possible to suppress the occurrence of defects due to heat generation by reflected electrons. In other words, it is possible to suppress the occurrence of a defect due to an increase in temperature around the coil 4*a* resulting from the combination of the heat generated in the wall portion 51 by the reflected electrons reflected without being absorbed by the target 31 and the heat generated in the coil 4*a* by energization. Examples of the defect include a decline in the controllability of the electron beam EB by the coil 4*a* and damage to a peripheral member. In a case where the temperature of the coil 4*a* is high, the dimension or position of the focal point of the X-ray XR may fluctuate due to a decline in the controllability of the electron beam EB. In addition, the vacuum may be broken due to damage to the window member 7 or the housing 36. Those defects can be suppressed in the X-ray generation apparatus 1.

The X-ray generation apparatus 1 was prepared and evaluated as a confirmation experiment. As a result, it has been confirmed that a rise in the temperature of the wall portion 51 and the magnetic lens 4 is suppressed. During a 1,000-hour operation, the dimension and position of the focal point of the X-ray XR did not fluctuate significantly. No abnormality occurred in the window member 7.

The flow path 61 extends so as to be positioned on both sides of the electron passage hole 52*a* in the Y direction when viewed from the X direction. As a result, it is possible to effectively cool the periphery of the electron passage hole 52*a* where a large amount of reflected electrons are incident.

The flow path 61 includes the plurality of curved parts 63 extending along the circumferential direction of a circle about the electron passage hole 52*a* when viewed from the X direction. As a result, the periphery of the electron passage hole 52*a* can be effectively cooled.

The flow path 61 includes the plurality of curved parts 63 arranged along the Z direction. As a result, the periphery of the electron passage hole 52*a* can be effectively cooled.

The flow path 61 includes the first part (curved part 63A) and the second part (curved part 63 other than the curved part 63A) connected to the first part and positioned on the side opposite to the electron passage hole 52*a* with respect to the first part. The X-ray generation apparatus 1 is configured such that the coolant CL2 flows from the first part to the second part. In other words, the X-ray generation apparatus 1 is provided with a coolant supply device configured such that the coolant CL2 flows from the first part to the second part. As a result, since the flow path 61 includes the first part and the second part, it is possible to lengthen the flow path of the coolant CL2 and it is possible to effectively cool the wall portion 51 and the magnetic lens 4. In addition, the periphery of the electron passage hole 52*a* can be effectively cooled since the coolant CL2 flows first to the first part near the electron passage hole 52*a*.

The X-ray passage hole 53*a* through which X-rays emitted from the target 31 pass is formed in the wall portion 51. When viewed from the X direction, the center C of the region RG where the flow path 61 is formed in the wall portion 51 is positioned on the side opposite to the X-ray passage hole 53*a* (upper side in FIG. 7) with respect to the electron passage hole 52*a*. As a result, the degree of freedom for design can be improved in relation to the X-ray passage hole 53*a*. For the flow path 61 to be formed on the X-ray passage hole 53*a* side with respect to the electron passage hole 52*a*, for example, there may be a need to thicken the second wall 53 where the X-ray passage hole 53*a* is formed. Such a situation does not occur in the embodiment described above.

The X-ray passage hole 53*a* is formed in the second wall 53 and the electron passage hole 52*a* and the flow path 61 are formed in the first wall 52. As a result, the degree of freedom for design can be improved in relation to the X-ray passage hole 53*a*.

The groove 62 is formed in the second surface 52*c* of the wall portion 51 and the flow path 61 is defined by the groove 62 being blocked by the housing 4*b* of the magnetic lens 4. As a result, the magnetic lens 4 can be effectively cooled. In addition, the manufacturing process can be simplified as compared with a case where the flow path 61 is formed inside the wall portion 51.

The wall portion 51 constitutes the housing 36 of the rotary anode unit 3. As a result, cooling can be performed by means of the housing 36 of the rotary anode unit 3.

Modification Example

Figure 8:
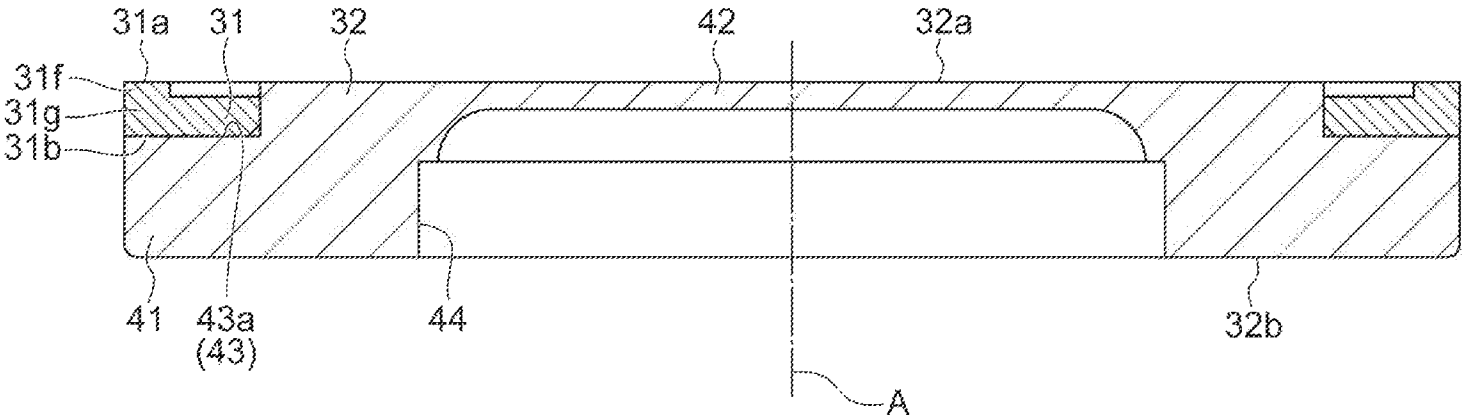
FIG. 8 is a cross-sectional view of a target and a target support body according to a modification example.

The target 31 and the target support body 32 may be configured as in the modification example that is illustrated in FIG. 8. In the modification example, the target 31 has an L-shaped cross section. The target 31 has a first part 31*f* and a second part 31*g*. The first part 31*f* includes the electron incident surface 31*a* and the second part 31*g* includes the back surface 31*b*. The width of the first part 31*f* is smaller than the width of the second part 31*g*. A gap is formed between the electron incident surface 31*a* and the surface 32*a* of the target support body 32. Also in the modification example, the electron incident surface 31*a* is positioned on the same plane as the surface 32*a*. The target 31 is fixed to the target support body 32 by the back surface 31*b* and the bottom surface 43*a* of the first recessed portion 43 being diffusion-bonded or joined by means of a brazing material. In such a modification example as well as the embodiment described above, the cooling performance is enhanced along with the workability of polishing work on the electron incident surface 31*a* of the target 31 and the surface 32*a* of the target support body 32.

The present disclosure is not limited to the above-described embodiment and modification example. For example, the materials and shapes of the configurations are not limited to the materials and shapes described above and various materials and shapes can be adopted. In the embodiment described above, the surface roughnesses Ra of both the bottom surface 43*a* of the first recessed portion 43 and the back surface 31*b* of the target 31 are 0.8 μm or less. Alternatively, the surface roughnesses Ra may be different from each other insofar as the sum of the surface roughnesses Ra of both is 1.6 μm or less. In the embodiment described above, the flow path 61 is defined by the groove 62 being blocked by the housing 4*b* of the magnetic lens 4. Alternatively, the flow path 61 may be formed as a hole inside the wall portion 51. Alternatively, the wall portion 51 itself may be provided with a lid-shaped member for blocking the groove 62. The flow path 61 may be formed in the wall portion that constitutes the housing 4*b* of the magnetic lens 4 instead of the wall portion 51 that constitutes the housing 36 of the rotary anode unit 3.

What is claimed is:

1. A rotary anode unit comprising:

a target formed of a first metal material and constituting an annular electron incident surface; and a target support body formed of a second metal material, formed in a flat plate shape, and having a first surface extending substantially perpendicularly to a rotation axis and a second surface on a side opposite to the first surface, wherein a thermal conductivity of the second metal material is higher than a thermal conductivity of the first metal material, the target support body has an inner part including the rotation axis and an outer part to which the target is fixed, a first recessed portion is formed in the first surface at the outer part, the target is disposed in the first recessed portion and the electron incident surface of the target is positioned on the same plane as the first surface, a second recessed portion configured to define a flow path for allowing a coolant to flow is formed in the second surface at the inner part, and a thickness of a first region where the first recessed portion is formed at the outer part is larger than a thickness of a second region where the second recessed portion is formed at the inner part.

2. The rotary anode unit according to claim 1, wherein a difference between the thickness of the second region and a thickness of the target is smaller than a difference between the thickness of the first region and the thickness of the second region.

3. The rotary anode unit according to claim 1, wherein a surface roughness Ra of at least one of a bottom surface of the first recessed portion and a surface of the target being in contact with the bottom surface is 1.6 μm or less.

4. The rotary anode unit according to claim 1, wherein a surface roughness Ra of the electron incident surface of the target is 0.5 μm or less.

5. The rotary anode unit according to claim 1, wherein a contact width between the target and a bottom surface of the first recessed portion is 2 t or more and 8 t or less when a thickness of the target is t.

6. The rotary anode unit according to claim 1, wherein an insertion hole penetrating through a bottom surface of the first recessed portion and the second surface is formed at the outer part, and the target is fixed to the target support body by a fastening member inserted through the insertion hole.

7. The rotary anode unit according to claim 1, further comprising a shaft fixed to the target support body from the second surface side and defining the flow path together with the second recessed portion.

8. The rotary anode unit according to claim 7, further comprising a flow path forming member having a tubular portion disposed in the shaft and a flange portion protruding outward from the tubular portion, the flow path forming member being defining the flow path together with the second recessed portion and the shaft.

9. An X-ray generation apparatus comprising the rotary anode unit according to claim 1.

* * * * *